US008182061B2

(12) United States Patent
Watanabe

(10) Patent No.: US 8,182,061 B2
(45) Date of Patent: May 22, 2012

(54) APPARATUS HAVING HEAD CLEANING UNIT FOR ENHANCED CAPABILITY FOR CLEANING LIQUID DISPENSING HEAD

(75) Inventor: Masaru Watanabe, Mitaka (JP)

(73) Assignee: Ricoh Company, Ltd., Tokyo (JP)

( * ) Notice: Subject to any disclaimer, the term of this patent is extended or adjusted under 35 U.S.C. 154(b) by 802 days.

(21) Appl. No.: 11/825,354

(22) Filed: Jul. 6, 2007

(65) Prior Publication Data

US 2008/0007592 A1 Jan. 10, 2008

(30) Foreign Application Priority Data

Jul. 7, 2006 (JP) ..... 2006-187380

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

| | | | | |
|---|---|---|---|---|
| 6,575,553 | B1 * | 6/2003 | Williams et al. | 347/22 |
| 6,766,817 | B2 | 7/2004 | da Silva | |
| 6,918,404 | B2 | 7/2005 | Dias da Silva | |
| 6,921,146 | B2 * | 7/2005 | Wouters | 347/33 |
| 7,066,586 | B2 | 6/2006 | da Silva | |
| RE39,242 | E * | 8/2006 | Johnson et al. | 347/28 |
| 7,285,255 | B2 | 10/2007 | Kadlec et al. | |
| 2002/0130921 | A1 * | 9/2002 | Anderson et al. | 347/33 |
| 2005/0052489 | A1 * | 3/2005 | Kim et al. | 347/29 |

FOREIGN PATENT DOCUMENTS

| | | |
|---|---|---|
| JP | 2002-127432 | 5/2002 |
| JP | 2002-283581 | 10/2002 |
| JP | 2003-25596 | 1/2003 |
| JP | 2003-154681 | 5/2003 |
| JP | 2004-167928 | 6/2004 |

OTHER PUBLICATIONS

May 31, 2011 Japanese official action in connection with a counterpart Japanese patent application.

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

A cleaning unit for use in an inkjet recording apparatus, having an inkjet head including a nozzle face, includes a first wiping member and a second wiping member. The first wiping member slides on the nozzle face in a given direction while in contact with the nozzle face to remove ink from the nozzle face and accumulate the ink to one side of the nozzle face. The second wiping member, disposed rearward of the first wiping member with respect to the given direction, removes the ink accumulated by the first wiping member.

9 Claims, 6 Drawing Sheets

$\theta_1 > \theta_2$ $\theta_1 > \theta_2$

APPARATUS HAVING HEAD CLEANING UNIT FOR ENHANCED CAPABILITY FOR CLEANING LIQUID DISPENSING HEAD

TECHNICAL FIELD

The present disclosure generally relates to improved capabilities for cleaning a liquid dispensing head, such as in an inkjet recording apparatus.

BACKGROUND

It is often a requirement for liquid dispensing apparatuses to regularly clean a liquid dispensing head of the apparatus.

For example, an inkjet recording apparatus (such as an inkjet printer) may include a head cleaning unit, which may be used to clean an inkjet head so that a contamination in apparatus or tainting of recording medium, caused by dripping or scattering of ink, can be prevented or suppressed. Such inkjet recording apparatus may include an inkjet head and a wiping member, for example. The inkjet head typically has a nozzle face including nozzle hole(s) for discharging ink to a recording medium, and the wiping member may remove ink adhered on the nozzle face of the inkjet head. Such inkjet recording apparatus may also include a wiping preparation unit, a wiper-contacting unit, and a wiper-separating unit, for example. The wiping preparation unit may position the wiping member to a ready-to-wipe position, which may be offset from the nozzle face of the inkjet head by a given distance. The wiper-contacting unit may position the wiping member to a position contactable to the inkjet head from the ready-to-wipe position, set by the wiping preparation unit. The wiper-separating unit may separate the wiping member at the contacting position from the inkjet head when a wiping operation is finished.

In such inkjet printer, ink may be accumulated to one end of the inkjet head by a first wiping process and then such accumulated ink may be removed by a second wiping process, for example. In such inkjet printer, a wiping operation may be conducted two times separately. However, in such instances, a cleaning time may undesirably become longer. Further, the wiping member elastically deform to return to its original shape when the wiping member finishes the wiping operation, because the wiping member may not be in contact with the inkjet head when the wiping member finishes the wiping operation, by which ink scattering may unfavorably occur.

In another inkjet printer, ink may be wiped from a recording head while ink scattering phenomenon is suppressed.

In such inkjet printer, ink may be discharged from a nozzle array, disposed on a head, to a recording medium to form an image on the recording medium. Such inkjet printer may include a cleaning blade under the head, slanted from an alignment direction of the nozzle array. Such cleaning blade may slide on the nozzle array face, while in contact with the nozzle array face, to remove ink from the nozzle array.

Although such cleaning blade may remove ink from the nozzle array gently from the nozzle array by positioning the cleaning blade in a slanted manner, such cleaning blade is typically not configured to remove ink accumulated at one end of the nozzle array.

In another case, an inkjet recording apparatus may include a head refreshing unit using dyestuff ink for refreshing a inkjet head for discharging pigment ink. Such dyestuff ink may be used only for refreshing operation. In such inkjet recording apparatus, pigment ink may become sticky on the inkjet head or in a capping of inkjet head.

A head refreshing operation may be conducted by adding (e.g., spraying) dyestuff ink to such sticky pigment ink, to render the sticky pigment ink fluid and effectively removed from the inkjet head.

In such inkjet recording apparatus, dyestuff ink may be used to prevent or suppress degradation of nozzle array used for discharging pigment ink.

Such method may be applicable for a color printer, which may use pigment ink for black ink and dyestuff ink for other color inks (e.g., cyan, magenta, and yellow), in which a dyestuff ink of black may be provided for the above-mentioned refreshing operation.

However, an increased demand on image quality produced by color printer may shift an ink material for color inks (e.g., cyan, magenta, and yellow) from dyestuff ink to pigment ink. In such color printer, the above-mentioned method using dyestuff ink for refreshing the inkjet head discharging pigment ink may not be applicable from a viewpoint of manufacturing or maintenance cost of printer. If dyestuff color inks (e.g., cyan, magenta, and yellow) to be used for refreshing operation may be provided in a color printer, such color printer may undesirably increase its size.

In another case, an inkjet printer may have a head-wiping unit for removing ink droplet adhered on a nozzle face of ink head while suppressing ink scattering.

Such head wiping unit may include a plurality of blades arranged with a given interval between blades in a movement direction of blade. Such blades may remove ink adhered on the nozzle face of the ink head, which may move with a carriage in a given scanning direction. In such head-wiping unit, one of the blades may contact with the ink head when removing ink from the ink head.

In general, an ink removing member may contact a nozzle surface with a given contact pressure or a given deflection amount due to a contact force of the ink removing member to the nozzle surface. In other words, the ink removing member may elastically deform its shape when removing ink from a nozzle surface so that ink removing member may contact closely on the nozzle surface.

In such configuration, such ink removing member may release its elastic force at the edge of the inkjet head once an ink removing operation has finished, by which an ink scattering may occur.

Conventionally, an inkjet recording apparatus may employ dyestuff ink and inkjet-specific sheets, in which an image quality produced on inkjet-specific sheets may be maintained at a given level.

With a growing demand of a higher image quality produced on a plain sheet by an inkjet recording apparatus, recent inkjet recording apparatuses may employ pigment ink having a relatively higher viscosity to prevent or suppress bleeding phenomenon on a plain sheet.

However, pigment ink more likely sticks on an ink head or a refreshing unit of an inkjet recording apparatus, and therefore such inkjet recording apparatus may have drawbacks such as degradation of head refreshing performance in a shorter period of time.

Further, an ink scattering during a cleaning operation may become serious because a mass weight of ink has increased due to employment of pigment ink.

In some case, pigment ink may be accumulated at a wiping head, or pigment ink scattered by removing operation may stick and accumulate on a refreshing unit or nozzle face, which may lead to a malfunctioning of refreshing unit, and image quality degradation.

BRIEF SUMMARY

The present disclosure describes a cleaning unit for cleaning a liquid dispensing head. For example, the cleaning unit can be used in an inkjet recording apparatus having an inkjet head including a nozzle face, and includes a first wiping member and a second wiping member. The first wiping member slides on the nozzle face in a given direction, while in contact with the nozzle face, to remove ink from the nozzle face and accumulate the ink to one side of the nozzle face. The second wiping member, disposed rearward of the first wiping member with respect to the given direction, removes the ink accumulated by the first wiping member.

In another aspect of the present disclosure an inkjet recording apparatus including an inkjet head, a first wiping member, and a second wiping member is described. The inkjet head has a nozzle face. The first wiping member slides on the nozzle face in a given direction while in contact with the nozzle face, to remove ink from the nozzle face and accumulate the ink to one side of the nozzle face. The second wiping member, disposed rearward of the first wiping member with respect to the given direction, removes the ink accumulated by the first wiping member.

The subject matter of the present disclosure, broadly speaking, includes a cleaning unit for cleaning a nozzle face of a liquid discharging device for discharging a fluid. The cleaning unit includes a first wiping member and a second wiping member. The first wiping member slides on the nozzle face in a given direction, while in contact with the nozzle face, to remove the fluid from the face and accumulate the fluid to one side of the face. The second wiping member, disposed rearward of the first wiping member with respect to the given direction, removes the fluid accumulated by the first wiping member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
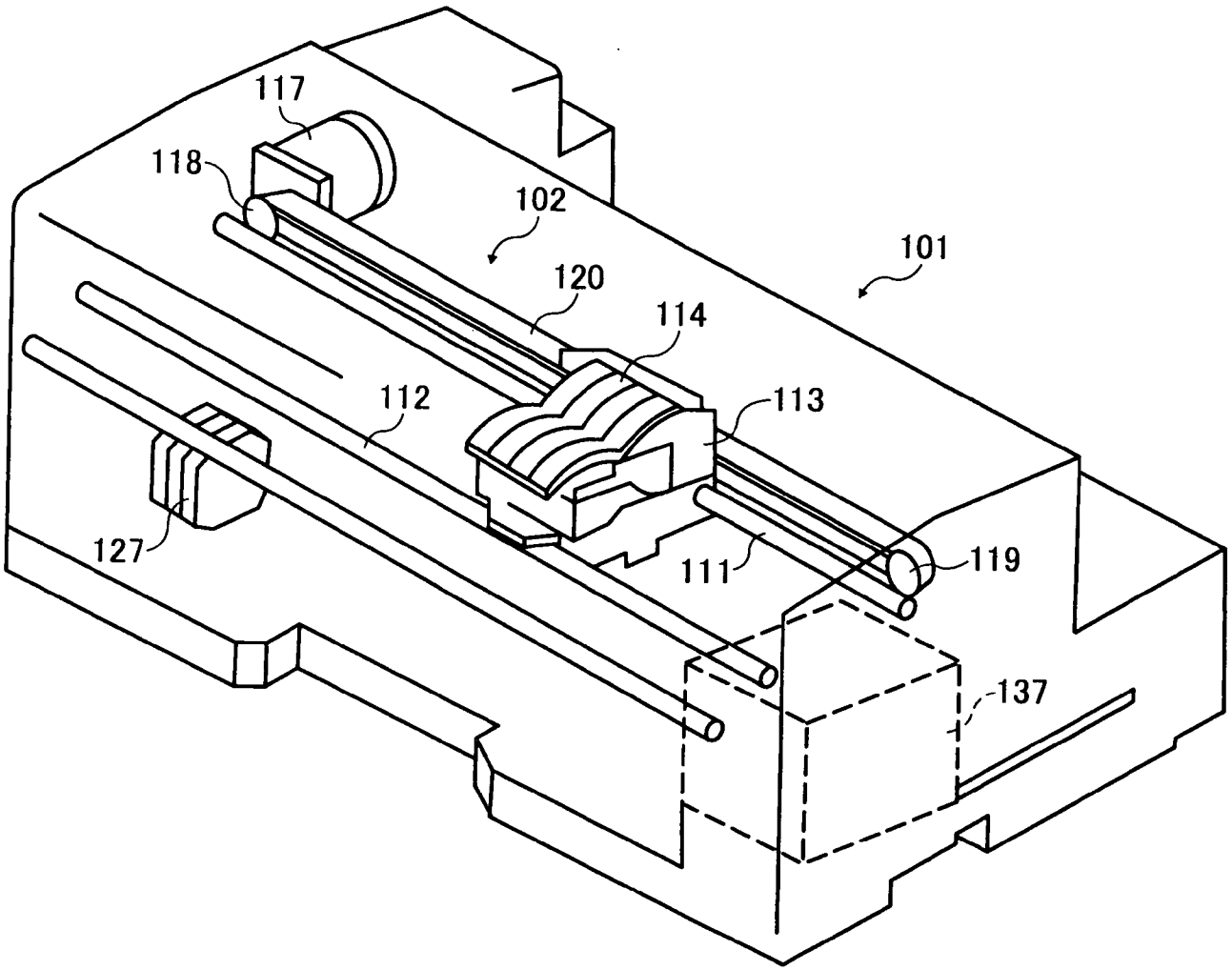
FIG. 1 is a perspective view of an image forming apparatus according to an exemplary embodiment of the present disclosure.

The accompanying drawings are intended to depict exemplary embodiments of the present disclosure and should not be interpreted to limit the scope of this disclosure or the appended claims. The accompanying drawings are not to be considered as drawn to scale unless explicitly noted.

DETAILED DESCRIPTION OF EXEMPLARY EMBODIMENTS

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein can be interpreted accordingly.

Although the terms first, second, etc., may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section, without departing from the teachings of the present disclosure.

The terminology used herein is for the purpose of describing particular exemplary embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments shown in the drawings, specific terminology is employed for the sake of clarity. However, the present disclosure is not intended to be limited to the specific terminology so selected and it is to be understood that each specific element includes all technical equivalents that operate in a similar manner.

Figure 2:
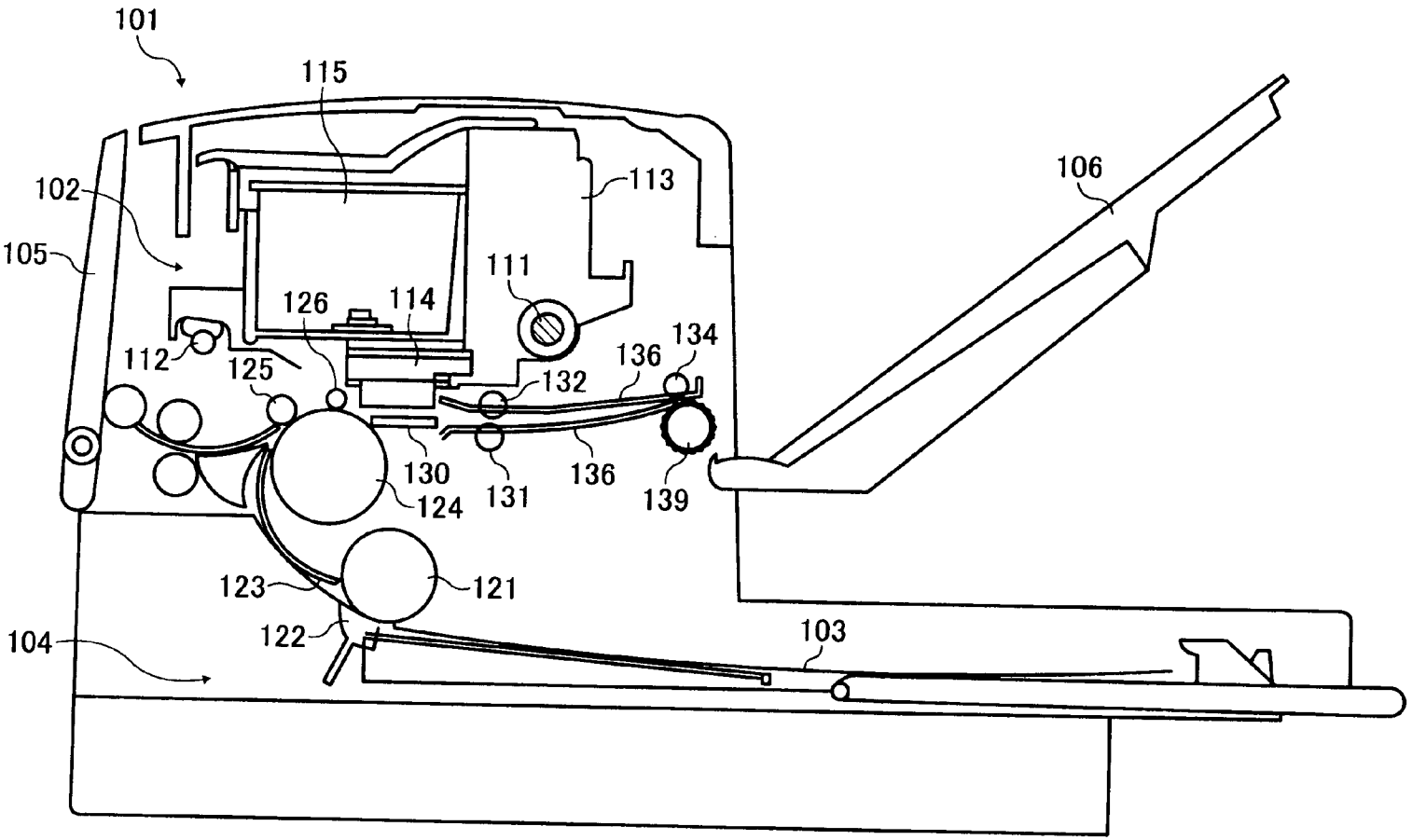
FIG. 2 is a schematic cross-sectional view of the image forming apparatus of FIG. 1.

Referring now to the drawings, wherein like reference numerals designate identical or corresponding parts throughout the several views, an image forming apparatus and a head-cleaning unit according to an exemplary embodiment is described with particular reference to FIGS. 1 and 2.

FIGS. 1 and 2 show a perspective view and a schematic cross-sectional view, respectively, of an image forming apparatus 101 according to an exemplary embodiment. The image forming apparatus 101 may include an inkjet printer, for example, is not be limited to an inkjet printer.

As shown in FIGS. 1 and 2, the image forming apparatus 101 may have a printing mechanism unit 102.

The printing mechanism unit 102 may include a carriage 113, a recording head 114 attached to the carriage 113, and an ink cartridge 115, for example.

The carriage 113 attached to the recording head 114 may be movable in a main scanning direction.

The recording head 114 may have an inkjet head, which may discharge ink while moving with the carriage 113 in the main scanning direction.

The ink cartridge 115 may supply ink to the recording head 114.

As shown in FIG. 1, the image forming apparatus 101 may include a main guide rod 111 and a sub-guide rod 112, extending in the main scanning direction of the image forming apparatus 101 as guide member.

The carriage 113 may be slidably supported on the main guide rod 111 and sub-guide rod 112 when the carriage 113 moves in the main scanning direction.

The recording head 114 may have a plurality of nozzles for discharging ink. Such nozzles may be arranged in a direction perpendicular to the main scanning direction, for example. The recording head 114 may discharge ink droplets to a downward direction.

The carriage 113 may be attached with the ink cartridge 115 for each color so that the recording head 114 is supplied with fresh ink. The ink cartridge 115 may be detachable from the carriage 113 so that a used ink cartridge is replaced with a new ink cartridge.

The ink cartridge 115 may include an air hole in an upper portion and a supply port in a lower portion. Thus, the ink cartridge 115 can be supplied with air through the air hole, and can supply ink to the recording head 114 through the supply port.

Further, the ink cartridge 115 may be filled with a porous material soaked with ink, and such ink may be maintained at a negative pressure of very low level. Ink may be supplied to the recording head 114 with an effect of the capillary force of the porous material.

As shown in FIG. 1, the carriage 113 may be slidably attached to the main guide rod 111 in a rearward direction of the carriage 113, and to the sub-guide rod 112 in a frontward direction of the carriage 113.

The carriage 113 may be driven by a driving unit having a main scanning motor 117, a drive pulley 118, a driven pulley 119, and a timing belt 120 extended between the drive pulley 118 and driven pulley 119.

The main scanning motor 117 may drive the drive pulley 118 to move the timing belt 120. The driven pulley 119 may be driven with a movement of the timing belt 120.

The carriage 113 may be fixed on the timing belt 120, and may move in a bi-directional manner along the main scanning direction by changing a rotation direction of the main scanning motor 117.

The image forming apparatus 101 may include a sheet cassette 104 in a lower side of the image forming apparatus 101 as shown in FIG. 2. As shown in FIG. 2, the sheet cassette 104 may be accessible from front portion of the image forming apparatus 101.

The sheet cassette 104 may store a larger number of sheets (hereinafter, sheet 103) and may be removable from the image forming apparatus 101 when refilling sheets in the sheet cassette 104.

The image forming apparatus 101 may include a sheet transporting unit to transport the sheet 103 from the sheet cassette 104 to the recording head 114.

Such sheet transporting unit may include a feed roller 121, a friction pad 122, a guide member 123, a transport roller 124, a first sub-transport roller 125, and a second sub-transport roller 126, for example.

The feed roller 121 may supply the sheet 103 one by one from the sheet cassette 104.

The guide member 123 may guide the sheet 103 to the transport roller 124.

The transport roller 124 may transport the sheet 103 to the recording head 114 while changing a transporting direction of sheet 103.

The transport roller 124 may be pressed with the first sub-transport roller 125.

The second sub-transport roller 126 may be used to regulate a sheet feed angle of the sheet 103 transported by the transport roller 124.

The transport roller 124 may be driven by a sub-scanning direction motor 127 via a gear.

The image forming apparatus 101 may further include a manual feed tray 105 on its backside. The manual feed tray 105 may be opened to feed a sheet in a manual mode.

Further, the image forming apparatus 101 may include a head counter member 130 facing the recording head 114. As shown in FIG. 2, the head-counter member 130 may be disposed in a downward direction of the recording head 114.

The head-counter member 130 may extend along the main scanning direction of the carriage 113 to guide the sheet 3, fed from the transport roller 124.

As shown in FIG. 2, the image forming apparatus 101 may further include support rollers 131 and 132, disposed on a downstream side of the head-counter member 130 to feed the sheet 103 in a sheet ejection direction.

As shown in FIG. 2, the image forming apparatus 101 may further include a sheet ejection roller 139 and a support roller 134, disposed in a downstream side of sheet transporting direction to feed the sheet 103 to an ejection tray 106 via a guide member 136, wherein the guide member 136 may be used as sheet ejection route.

In such configured image forming apparatus 101, the sheet 103 may be transported to the printing mechanism unit 102 from the sheet cassette 104 or manual feed tray 105.

The recording head 114 of the carriage 113 may be activated in response to image signals to discharge ink for one-line of image onto the sheet 103, which is stopped for a given time during one-line image recording. After completing one-line image recording, the sheet 103 may be moved for a given length so that the recording head 114 can conduct another one-line image recording onto the sheet 103.

Through conducting such one-line image recording repeatedly, a whole image may be recorded on the sheet 103.

When a controller of the image forming apparatus 101 receives a signal indicating a recording-completed or a signal indicating that the rear end of sheet 103 may enter a recording area, for example, the controller may stop a recording operation, and eject the sheet 103 to the ejection tray 106.

Hereinafter, a head cleaning unit according to an exemplary embodiment may be explained with reference to FIG. 3 to 5.

FIGS. 3A through 3E are schematic views of a head cleaning unit according to an exemplary embodiment. Specifically, FIGS. 3A through 3E show respective snapshots illustrating relative positions of a nozzle face of an inkjet head on the one hand and on the other hand first and second wiping members during a cleaning operation (or wiping operation). FIG. 3 shows a configuration viewed from a downside direction of a nozzle face.

Figure 3A:
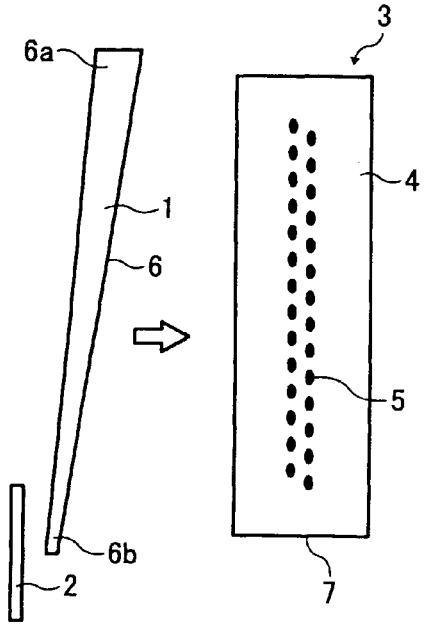
FIG. 3A through 3E show schematic views explaining a positional relationship of an ink removing member and a nozzle face, and a process of removing ink.
Figure 3B:
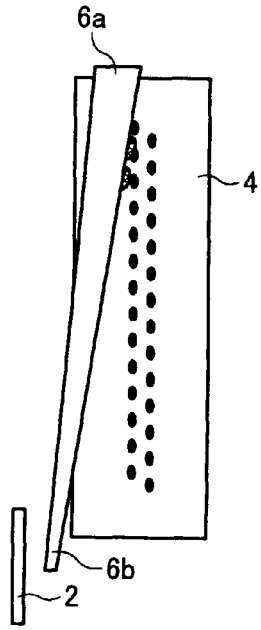

As shown in FIG. 3A, such head cleaning unit may include a first wiping member 1 and a second wiping member 2, for example.

The second wiping member 2 may be disposed at a position which is close to one end of the first wiping member 1. For example, the second wiping member 2 may be disposed rearward of the first wiping member 1 moving in a given direction.

The first wiping member 1 may be formed with an elastic member, and may have an ink removing face 6.

The ink removing face 6 may be slanted with respect to a nozzle array 5 on a nozzle face 4 of an inkjet head 3 as shown in FIG. 3. In other words, the ink removing face 6 may not be parallel with the nozzle array 5 having a plurality of aligned nozzles.

Such ink removing face 6 of first wiping member 1 may slide on the nozzle face 4 while in contact with nozzle face with a given contact angle. Such contact angle may be greater at a first end side 6*a*, and may be smaller at a second end side 6*b* of the first wiping member 1. In other words, such contact angle may become gradually smaller as it comes closer to the second end side 6*b*.

The first wiping member 1 may remove ink on the nozzle face 4 in a direction from the first end side 6*a* to the second end side 6*b*.

As shown in FIG. 3, a thickness of first wiping member 1 may be thicker at the first end side 6*a* and thinner at the second end side 6*b*. In other words, a thickness of the first wiping member 1 may become gradually thinner as it comes closer to the second end side 6*b*.

Because a thickness of the first wiping member 1 may be thinner as it comes closer to the second end side 6*b*, a deflection amount of first wiping member 1 may become greater as it comes closer to the second end side 6*b* under a same contact force, by which a contact angle of first wiping member 1 to the nozzle face 4 may become smaller as it comes closer to the second end side 6*b*.

Figure 4A:
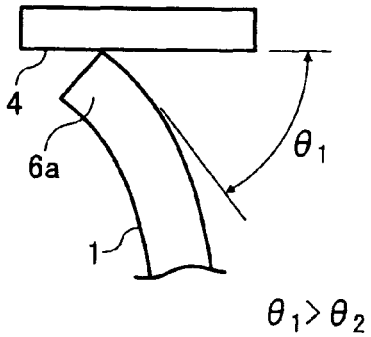
FIGS. 4A through 4D show a contact angle between a first wiping member and a nozzle face.
Figure 4B:
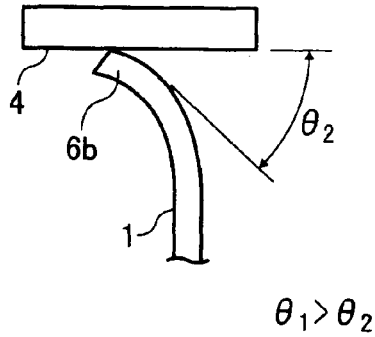
Figure 4C:
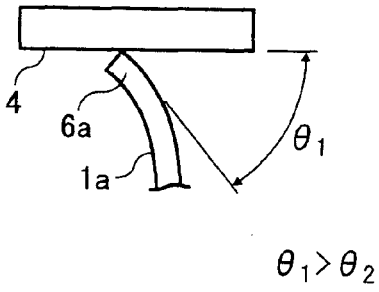
Figure 4D:
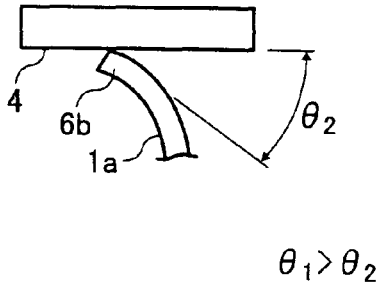

FIGS. 4A and 4B show a contact angle of the first wiping member 1 to the nozzle face 4 at the first end side 6*a* and second end side 6*b*, respectively, in which a thickness of the first wiping member 1 becomes thinner as it comes closer to the second end side 6*b*.

As shown in FIG. 4A, a first contact angle θ1 at the first end side 6*a* may be greater than a second contact angle θ2 at the second end side 6*b*. In other words, the second contact angle θ2 may be smaller than the first contact angle θ1.

Although the first wiping member 1 may contact the nozzle face 4 with a given contact force maintained at a substantially same level at any points of the first wiping member 1, a deflection amount of the first wiping member 1 may change because the first wiping member 1 may have an uneven thickness as above-mentioned.

Specifically, a deflection amount of the first wiping member 1 may gradually become greater as it comes closer to the second end side 6*b*, and a contact angle of the first wiping member 1 may gradually become smaller as it comes closer to the second end side 6*b*.

As shown in FIGS. 4A and 4B, the first wiping member 1 may slide on the nozzle face 4, while it is in contact with the nozzle face, and a contact angle of the first wiping member 1 with the nozzle face 4 gradually decreases as it slides closer to the second end side 6*b*.

With such wiping operation, the first wiping member 1 may remove ink adhered on the nozzle face 4, and accumulate removed ink to the second end side 6*b*.

The first wiping member 1 may be in contact with the nozzle face 4 with a given contact force, such as 100 to 200 gf, for example.

If the contact force becomes too great, the first wiping member 1 may not effectively remove ink due to a stick-slip phenomenon. If the contact force becomes too small, the first wiping member 1 may not effectively remove ink due to a too-little deformation.

Further, the first wiping member 1 may be moved with a given wiping speed, such as in a range of 30 mm/sec to 80 mm/sec (for example, 50 mm/sec).

If the wiping speed becomes too slow, the first wiping member 1 may not effectively remove ink due to a slipping phenomenon, in which ink droplets remain on the nozzle face. If the wiping speed becomes too great, the first wiping member 1 may not effectively remove ink due to a too-little deformation, and in such condition, the first wiping member 1 may not contact nozzles effectively.

The second wiping member 2, disposed near the nozzle face 4, may be formed of elastic material. The second wiping member 2 may slide on a nozzle side face 7 while in contact with the nozzle side face, as shown in FIG. 3.

The second wiping member 2 may remove ink from the inkjet head 3, accumulated by the first wiping member 1 at the second end side 6*b*.

Figure 5A:
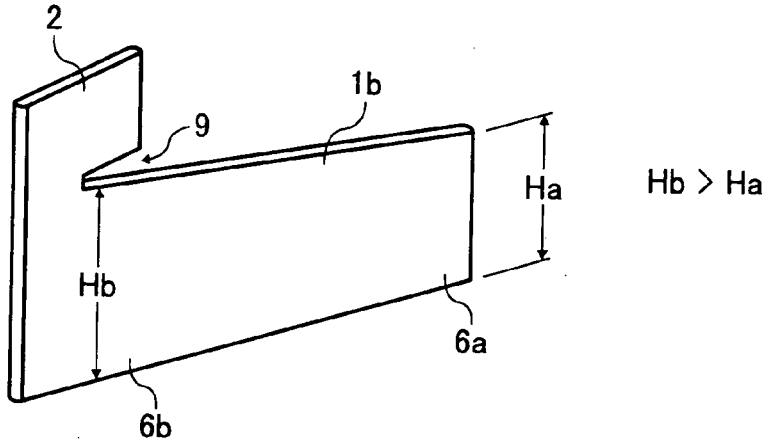
FIGS. 5A through 5C show schematic views of an exemplary configuration of a first wiping member and a second wiping member integrally formed.

As shown in FIG. 5A, a first wiping member and second wiping member may be formed integrally as one member while providing a slit therebetween, for example.

FIG. 5A is a schematic view of a first wiping member 1*b* and second wiping member 2 formed integrally.

As shown in FIG. 5A, the first wiping member 1*b* and second wiping member 2 may be formed integrally from an elastic member having a sheet-like shape while providing a slit 9 in the elastic member.

In other words, with such slit processing, the second wiping member 2 may be disposed on one side of the slit, and the first wiping member 1*b* may be disposed on another side of the slit as shown in FIG. 5A. Such first wiping member 1*b* and second wiping member 2 may conduct a wiping or removing operation separately.

Further, as shown in FIG. 5A, a height of the first wiping member 1*b* may gradually become greater in a direction from the first end side 6*a* to the second end side 6*b* of the first wiping member 1*b*.

Specifically, a height Ha at the first end side 6*a* of first wiping member 1*b* may be smaller than a height Hb at the second end side 6*b*, which may be expressed as "Ha<Hb."

Figure 5B:
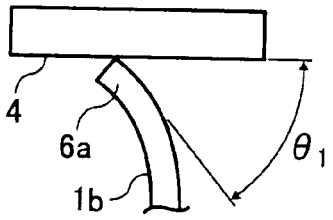

At the first end side 6*a*, a deflection amount of the first wiping member 1*b* may be relatively smaller while having a relatively greater contact angle θ1 as shown in FIG. 5B.

Figure 5C:
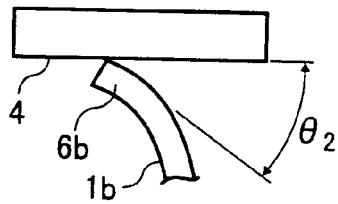

At the second end side 6*b*, a deflection amount of the first wiping member 1*b* may be relatively greater while having a relatively smaller contact angle θ2 as shown in FIG. 5C.

As such, as the nozzle face comes closer to the second end side 6*b* of the first wiping member 1*b*, a deflection amount of the first wiping member 1*b* may become gradually greater while gradually decreasing a contact angle with the nozzle face 4.

Accordingly, the first wiping member 1*b* may effectively accumulate removed ink to the second end side 6*b* with an effect of a capillary phenomenon of the first wiping member 1*b*, which may be effectively generated with the above-mentioned configuration such that a deflection amount of the first wiping member 1*b* becomes gradually greater while gradually decreasing a contact angle with the nozzle face 4 as it comes closer to the second end side 6*b* of the first wiping member 1*b*.

In the above-explained exemplary embodiment, the nozzle face 4 of inkjet head 3 may be cleaned as described below.

Before conducting a cleaning operation (or wiping operation), the first wiping member 1 and second wiping member 2 may be positioned in a downward direction of the nozzle face 4. In other words, the first wiping member 1 and second wiping member 2 may not be in contact with the nozzle face 4 before conducting a cleaning operation (or wiping operation) as shown in FIG. 3A.

Accordingly, when conducting a cleaning operation (or wiping operation), the first wiping member 1 may be moved in an upward direction for a given distance so that the first wiping member 1 is in contact with the nozzle face 4 during a cleaning operation (or wiping operation).

As shown in FIGS. 3B to 3E, the first wiping member 1 comes in contact with the nozzle face 4 with the ink removing face 6 with a given contact force such as 100 gf to 200 gf.

When conducting a cleaning operation (or wiping operation), the first wiping member 1 may be moved on the nozzle face 4, or the carriage 113 having the inkjet head 3 may be moved in a given direction.

Under such condition, the first wiping member 1 may elastically deform and have a given deflection amount by such elastic deformation. With such deflected condition, the first wiping member 1 may slide on the nozzle face 4 while in contact with the nozzle face to remove ink adhered on the nozzle face 4.

When the first wiping member 1 removes ink from the nozzle face 4, such removed ink may be moved and accumulated to the second end side 6*b*.

Such accumulated ink on the second end side 6*b* may remain on the nozzle side face 7 of the inkjet head 3.

Figure 3C:
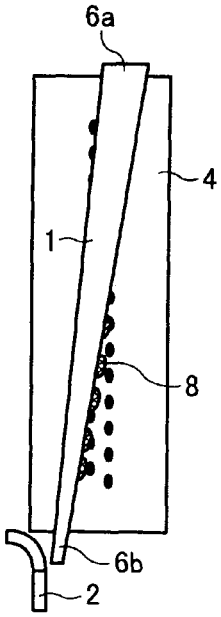
Figure 3D:
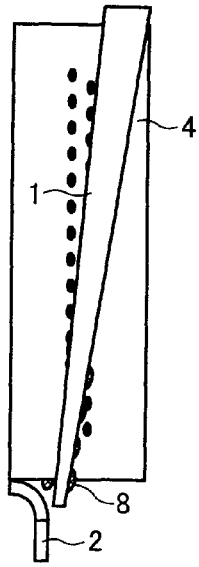
Figure 3E:
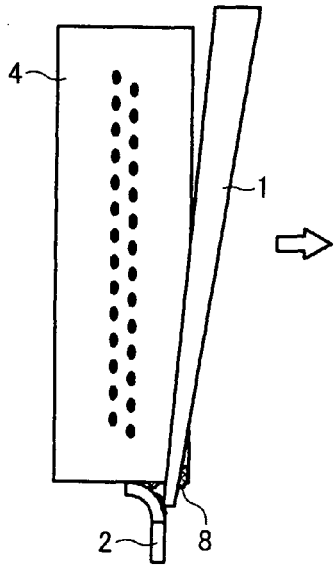

Such ink remaining on the nozzle side face 7 of the inkjet head 3 may be wiped by the second wiping member 2, deflected for a given deflection amount as shown in FIGS. 3C to 3E.

As shown in FIGS. 3A through 3E, the first wiping member 1 and second wiping member 2 may have a given positional relationship with each other, in which the second wiping member 2 may be positioned in rearward with respect to the first wiping member 1 moving in a direction shown by an arrow in FIG. 3A.

During such ink removing (or wiping) operation by the first wiping member 1, removed ink may be sucked effectively to the second end side 6*b* with an effect of capillary phenomenon of the first wiping member 1.

Such capillary phenomenon may be enhanced by the slanted ink removing face 6 and gradually-decreased contact angle of the first wiping member 1 to the nozzle face 4.

As shown in FIG. 3, the ink removing face 6 of the first wiping member 1 may be slanted from a direction of the nozzle array 5 on the nozzle face 4, and the contact angle of the first wiping member 1 to the nozzle face 4 may become gradually smaller as it comes closer to the second end side 6*b* by gradually decreasing a thickness of first wiping member 1 from the first end side 6*a* to the second end side 6*b* as shown in FIGS. 3A through 3E.

Such configuration preferably increases an effect of capillary phenomenon by the first wiping member 1. Accordingly, such first wiping member 1 preferably increases clean-ability of the nozzle face 4.

In an exemplary embodiment, the first wiping member 1 has a thickness which may become gradually thinner from the first end side 6*a* to second end side 6*b* as shown in FIG. 3. Accordingly, the first wiping member 1 may have a smaller contact angle with the nozzle face 4 as it comes closer to the second end side 6*b* as shown in FIGS. 4A and 4B.

With such configuration of the first wiping member 1, ink can be removed and accumulated to the second end side 6*b* effectively, and such accumulated ink can be effectively removed (or wiped) by the second wiping member 2.

Accordingly, the image forming apparatus 101 can conduct an image forming operation (e.g., printing operation) at a preferable condition in a stable manner because the above-explained head cleaning unit can effectively prevent or suppress accumulation of ink on the inkjet head 3.

Further, in an exemplary embodiment, the first wiping member 1 and second wiping member 2 may be integrally formed by providing a slit on a sheet material (refer to FIG. 5A), by which a manufacturing cost of a wiping member (or removing member) may be reduced.

In an exemplary embodiment, the nozzle side face 7, on which the second wiping member 2 may slide while in contact with said nozzle side face, may be preferably coated with a water repellent agent.

With such water repellent coating, the second wiping member 2 preferably removes ink accumulated near the nozzle side face 7, by which an accumulation of ink on the nozzle side face 7 can be prevented or suppressed.

Further, the second wiping member 2 may be positioned at a given position to set a portion of second wiping member 2 over the nozzle face 4. In such a case, the second wiping member 2 slides on the nozzle side face 7 while the above-mentioned portion effectively contacts an edge of nozzle face 4. Such positioned second wiping member 2 effectively cleans the nozzle side face 7.

In an exemplary embodiment, the nozzle face 4 and nozzle side face 7 preferably have a relatively greater water-repellency compared to the first wiping member 1 and second wiping member 2.

With such conditioning, the first wiping member 1 and second wiping member 2 used as an ink removing member can have relatively greater hydrophilic property, by which ink can be removed more easily by the first wiping member 1 and second wiping member 2. Accordingly, ink can be removed from the nozzle face 4 more effectively by the first wiping member 1 and second wiping member 2.

In an exemplary embodiment, the above-mentioned water repellent coating can be formed on the nozzle face 4 or nozzle side face 7 with any known methods.

For example, such methods may include a vapor deposition method, which deposits a water repellent agent under vacuum condition, and a coating method, which uses a water repellent agent solved in a solvent.

In case of vapor deposition method, a vacuum chamber may be ventilated to a given vacuum level with a vacuum pump at first. Water-repellent agent evaporated under a temperature of 400 degree Celsius may be introduced to the vacuum chamber under such vacuum condition. By adjusting vacuum pressure, a RF (radio frequency) glow discharge may be generated by supplying power to a discharge electrode from a higher frequency power source. Under a plasma atmosphere, generated by such discharge, an orifice face of ink discharging head may be processed with surface treatment, by which a water repellent coating may be formed on the orifice face. Such water repellent coating may be formed at a relatively lower temperature such as room temperature to 200 degree Celsius depending on material and vacuum level of vacuum chamber.

In case of coating method, water-repellent agent may be solved in organic solvent, and such water-repellent agent may be coated on a part with wire bar or doctor blade, or by spin coating method, or by spray coating, or by a dipping method to coat water-repellent agent on a part, for example.

The water-repellent agent may include organic compound having fluorine atom, and more particularly, organic material and organosilicon compound having fluoroalkyl group.

Preferably, the organic compound having fluorine atom may include fluoroalkyl silane, and alkane, carboxylic acid, alcohol, and amine having fluoroalkyl group, for example.

The fluoroalkyl silane may include heptadecafluoro 1,1,2,2-tetrahydro decyltrimethoxysilane, and heptadecafluoro 1,1,2,2-tetrahydro trichlorosilane, for example.

The alkane having fluoroalkyl group may include octafluorocyclobutane, perfluoro methylcyclohexane, perfluoro n-hexane, perfluoro n-heptane, tetradecafluoro 2-methylpentane, perfluoro dodecane, and perfluoro icosane, for example.

The carboxylic acid having fluoroalkyl group may include perfluoro decanoic acid, and perfluoro octanoic acid, for example.

The alcohol having fluoroalkyl group may include 3,3,4,4,5,5,5-heptafluoro 2-pentanol, for example.

The amine having fluoroalkyl group may include heptadecafluoro 1,1,2,2-tetrahydro decyl amine, for example.

The organosilicon compound having dimethylsiloxane structure may include α,w-bis(3-aminopropyl)polydimethylsiloxane, α,w-bis(3-glycidexypropyl)polydimethylsiloxane, and α,w-bis(vinyl)polydimethylsiloxane, for example.

Further, the water-repellent agent may further include organic compound having silicon atom, and more particularly, organic compound having alkylsiloxane group.

The organic compound having alkylsiloxane group may include high polymer compound (A) expressed by the general formula (a) and (b) as shown below. For example, epoxy resin material having alkylsiloxane may include two or more of alkylsiloxane group and cyclic fatty epoxy group therein.

(A)

(a)

(b)

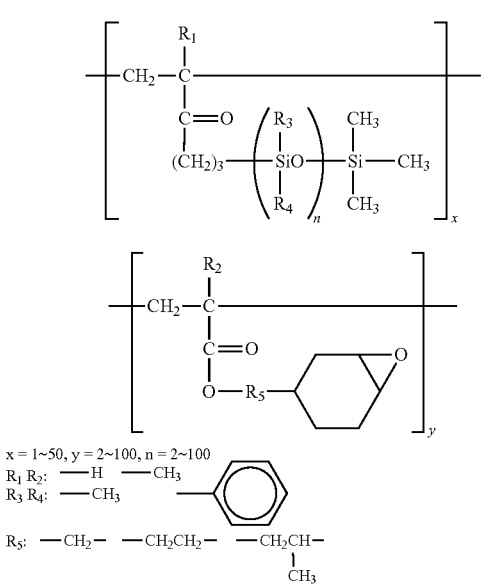

Such compound having the above-mentioned structure may function as a binder if used together with another water-repellent agent. Such compound may enhance permeability of ink compound on a sheet. Further, such compound may improve drying speed of ink discharged on a sheet, by which image forming operation may be conducted efficiently.

The water repellent coating may preferably have a thickness of 5 μm or less, and more preferably 2 μm or less.

If the thickness of water repellent coating becomes too thick, such coating may need a longer time to be dried, which may lead to a lower productively, or such coating may have a lower mechanical durability after drying, which may cause a peeling of coating during a cleaning operation (or wiping operation).

In an exemplary embodiment, the first wiping member 1 has a thickness which becomes gradually thinner from the first end side 6*a* to second end side 6*b* so that the first wiping member 1 contacts the nozzle face 4 with a contact angle which becomes gradually smaller from the first end side 6*a* to second end side 6*b*.

Further, the first wiping member 1 may have a height, which becomes relatively higher gradually from the first end side 6*a* to second end side 6*b* so that the first wiping member 1 deforms a greater degree as the nozzle face 4 comes closer to the second end side 6*b*.

If the first wiping member 1 deforms a greater degree, the first wiping member 1 may contact the nozzle face 4 with a contact angle, which becomes gradually smaller from the first end side 6*a* to the second end side 6*b*.

FIG. 4B shows a contact angle of first wiping member 1*a* to the nozzle face 4 at the first end side 6*a* and second end side 6*b*. In such example, the first wiping member 1*a* has a height which becomes gradually greater from the first end side 6*a* to the second end side 6*b*.

In the example shown in FIG. 4B, a first contact angle θ1 at the first end side 6*a* is greater than a second contact angle θ2 at the second end side 6*b*. In other words, the second contact angle θ2 is smaller than the first contact angle θ1.

With such configuration, the first wiping member 1*a* effectively removes and accumulates ink to the second end side 6*b*.

Further, the first wiping member 1 has a thickness and height which becomes gradually thinner and higher from the first end side 6*a* to second end side 6*b*. Such first wiping member 1 may also contact the nozzle face 4 with a contact angle, which becomes gradually smaller from the first end side 6*a* to the second end side 6*b*. Such first wiping member 1 may similarly effectively remove and accumulate ink to the second end side 6*b*.

Further, in an exemplary embodiment, the first wiping member 1 and second wiping member 2 may be formed integrally by inflecting a sheet-like material.

Figure 6:
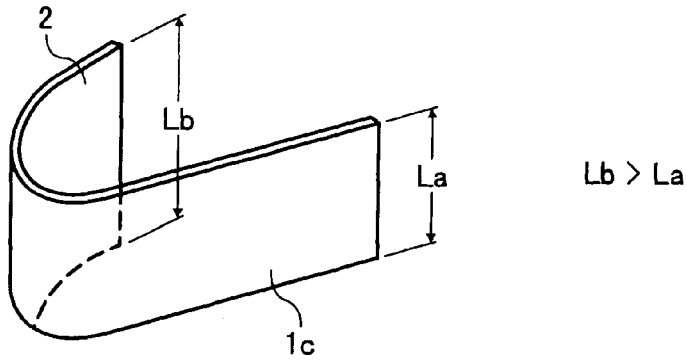
FIG. 6 shows a schematic view of another exemplary configuration of a first wiping member and a second wiping member integrally formed.

FIG. 6 shows a first wiping member 1*c* and second wiping member 2 integrally formed with an inflected sheet-like elastic member.

As shown in FIG. 6, an end length Lb of second wiping member 2 may be set longer than an end length La of first wiping member 1*c*.

With such configuration for first wiping member 1*c* and second wiping member 2, ink removed from the nozzle face 4 by the first wiping member 1*c* may be effectively removed by the second wiping member 2.

Because the first wiping member 1*c* and second wiping member 2 can be integrally formed by inflecting a sheet-like elastic member as shown in FIG. 6, a removing member having function of the first wiping member 1*c* and second wiping member 2 may be manufactured with a lower cost.

Figure 7:
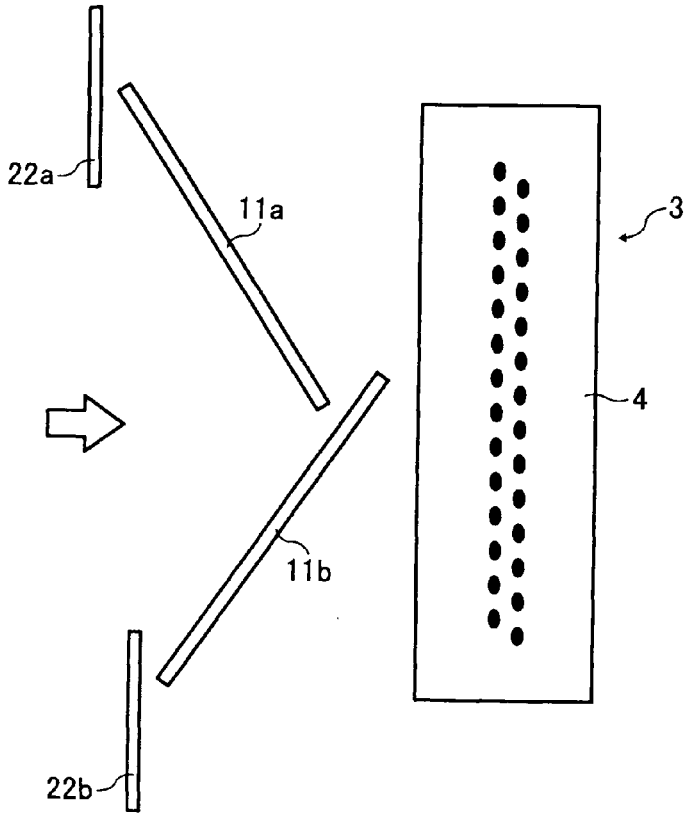
FIG. 7 shows a schematic view explaining positional relationship of ink removing members and a nozzle face, according to another example.

FIG. 7 shows a configuration for a head cleaning unit according to another exemplary embodiment.

The head cleaning unit shown in FIG. 7 may include first wiping members 11*a* and 11*b*, and second wiping members 22*a* and 22*b*, for example.

The first wiping member 11*a* accumulates ink in a direction from a center to one end of the inkjet head 3, and the first wiping member 11*b* accumulates ink in a direction from a center to the other end of the inkjet head 3, and the second wiping members 22*a* and 22*b* are used with the first wiping members 11*a* and 11*b*, respectively.

In such configuration, a plurality of first wiping members and second wiping members may be used for cleaning the nozzle face 4.

Specifically, the first wiping member 11*a* removes ink from a part of the nozzle face 4 and the second wiping member 22*a* removes ink, removed and accumulated by the first wiping member 11*a*, from one side face of the nozzle face 4. Similarly, the first wiping member 11*b* removes ink from another part of the nozzle face 4 and the second wiping member 22*b* removes ink, removed and accumulated by the first wiping member 11*b*, from other one side face of the nozzle face 4.

Such configuration using a plurality of first wiping members and second wiping members enhances a cleaning-ability of a nozzle face having a relatively greater dimension.

For example, such configuration using a plurality of wiping members enhances an efficiency of accumulating ink to an end side of nozzle face, and effectively removes such accumulated ink from the nozzle face.

Numerous additional modifications and variations are possible in light of the above teachings. It is therefore to be understood that within the scope of the appended claims, the disclosure of the present invention may be practiced otherwise than as specifically described herein.

This application claims priority from Japanese patent application No. 2006-187380 filed on Jul. 7, 2006 in the Japan Patent Office, the entire contents of which is hereby incorporated by reference herein.

What is claimed is:

1. An inkjet recording apparatus, comprising:

an inkjet head having a nozzle face and a side face adjacent to the nozzle face; and a first wiping member configured to slide on the nozzle face in a given direction that is perpendicular to a long side direction of the nozzle face and that is parallel to a short side direction of the nozzle face, while in contact with the nozzle face, to remove ink from the nozzle face and accumulate the ink to one side of the nozzle face, said first wiping member having a removing start edge, a removing end edge, and a fluid removing face that is in contact with the nozzle face, a long side direction of the fluid removing face being arranged substantially along the long side direction of the nozzle face, the fluid removing face being slanted at an angle less than 90° relative to the given direction in which the first wiping member slides on the nozzle face, and a portion of the fluid removing face at the removing start edge being ahead of a portion of the fluid removing face at the removing end edge in the given direction in which the first wiping member slides on the nozzle face; and a second wiping member, disposed rearward of the first wiping member with respect to the given direction, and configured to move in a specific direction corresponding to the given direction that is parallel to the short side direction of the nozzle face, to contact the side face of the inkjet head and remove the ink accumulated by the first wiping member, a portion of said second wiping member contacting an edge at which the short side of the nozzle face and the side face of the inkjet head come together, wherein the second wiping member slides on the side face of the inkjet head along the short side direction of the nozzle face in the specific direction corresponding to the given direction to remove the ink from the short side of the nozzle face, and wherein the fluid removing face of the first wiping member contacts the nozzle face at a first contact angle at the removing start edge and at a second contact angle at the removing end edge, an effect of elastic deformation causing the first contact angle to be greater than the second contact angle, the ink is removed from the nozzle face and moved to and accumulated at the removing end edge of the first wiping member, and the ink accumulated by the first wiping member is removed by the second wiping member.

2. The inkjet recording apparatus according to claim 1, wherein the side face of the inkjet head has water-repellency, and the second wiping member slides, while in contact with, on the side face of the inkjet head.

3. The inkjet recording apparatus according to claim 1, wherein the nozzle face and side face of the inkjet head have water-repellency, and the first and second wiping members slide on, while in contact with, the nozzle face and the side face, respectively, of the inkjet head, and the nozzle face and the side face have greater water-repellency as compared to the first and second wiping members.

4. The inkjet recording apparatus according to claim 1, wherein the first and second wiping members have greater hydrophilic property as compared to the nozzle face and side face of the inkjet head, respectively.

5. The inkjet recording apparatus according to claim 1, wherein the first wiping member has a first blade thickness at the removing start edge and a second blade thickness at the removing end edge, the first blade thickness being greater than the second blade thickness.

6. The inkjet recording apparatus according to claim 1, wherein the first wiping member has a first blade height at the removing start edge and a second blade height at the removing end edge, the first blade height being smaller than the second blade height.

7. The inkjet recording apparatus according to claim 1, wherein the first and second wiping members are formed integrally by providing a slit to a given position in an elastic material.

8. The inkjet recording apparatus according to claim 1, wherein the first and second wiping members are formed integrally by inflecting an elastic material.

9. The inkjet recording apparatus according to claim 1, wherein each of the first wiping member and second wiping member includes at least two wiping members.

* * * * *